United States Patent [19]

Lang et al.

[11] 4,090,373

[45] May 23, 1978

[54] APPARATUS FOR CONTROLLING AN INTERNAL DOOR OF AN AIR CONDITIONING UNIT

[75] Inventors: Richard D. Lang, Chittenango; Theodore S. Bolton, Liverpool, both of N.Y.

[73] Assignee: Carrier Corporation, Syracuse, N.Y.

[21] Appl. No.: 761,825

[22] Filed: Jan. 24, 1977

[51] Int. Cl.[2] ..... F25D 23/12

[52] U.S. Cl. ..... 62/262; 62/409; 62/427; 98/94 AC; 312/214; 312/236

[58] Field of Search ..... 62/262, 409, 427; 98/94 AC; 312/214, 236

[56] References Cited

U.S. PATENT DOCUMENTS

| | | | |
|---|---|---|---|
| 2,720,090 | 10/1955 | Ford | 62/427 |
| 2,986,016 | 5/1961 | Gillham et al. | 62/262 |
| 3,194,028 | 7/1965 | Bell, Jr. | 62/427 |
| 3,823,574 | 7/1974 | Bolton | 62/427 |
| 3,921,416 | 11/1975 | Murnane | 62/427 |
| 3,932,157 | 1/1976 | Bolton et al. | 62/427 |

*Primary Examiner*—Ronald C. Capossela
*Attorney, Agent, or Firm*—J. Raymond Curtin; Robert P. Hayter

[57] ABSTRACT

A control mechanism for moving a door of an air conditioner which includes a mounted movable carriage in contact with a biased door. The carriage by means of a connected resilient arm containing a pin which slidably follows a ramp arrangement holds the door in an open position when operated in a single direction and released. Upon the second operation in the same direction and subsequent release the biased door returns to a closed position and the control mechanism returns to its initial position.

14 Claims, 6 Drawing Figures

APPARATUS FOR CONTROLLING AN INTERNAL DOOR OF AN AIR CONDITIONING UNIT

BACKGROUND OF THE INVENTION

This invention relates to air conditioning units which are adapted to exhaust unwanted air as well as to provide conditioned air to a room being served by the unit. More specifically, the present invention relates to apparatus for moving a door covering an exhaust port in a self contained air conditioner having the foregoing capability.

Air conditioning units which are commonly used for residential and similar application generally are contained within a single casing. This casing is usually divided by a partition into an evaporator section and a condenser section, each section having its own fan to circulate air therein. The air conditioning unit is normally mounted with the evaporator section communicating with the room air to be conditioned and the condenser section communicating with external air such as outside air. Refrigerant flows through the self contained refrigerant circuit removing heat from the room air and discharging heat to the outside air.

In addition to the capability of the air conditioning unit to provide temperature controlled air to the room, it is desirable for the unit to have means for exhausting unwanted room air from the room to the outside. This is accomplished by the location of a port in the partition separating the condenser section from the evaporator section. A part of the room air enters the evaporator section of the unit and is forced by the evaporator and condenser fans thru the port into the condenser section communicating with outside air.

Since the port must be selectively open when the unit is in the exhaust mode of operation, that mode in which part of the unwanted room air is being exhausted, and closed when the unit is in the separate mode of operation to condition the room air, a door is provided to cover the port and a control mechanism is necessary to maintain the door in the appropriate position.

Previous door control mechanisms such as those shown by U.S. Pat. Nos. 3,932,157, 3,921,416, 3,823,574, 3,194,028, all assigned to the assignee hereof, and the references cited therein, while effective, have been relatively complex, requiring numerous parts and considerable skill and effort to assemble the parts. Moreover, prior mechanisms have been awkward to operate and have required the exertion of considerable force to change door positions. Furthermore, mechanisms of the preceding type have tended to make access to the interior of unit for service more difficult.

SUMMARY OF THE INVENTION

An object of the present invention is to provide an air conditioning unit with improved means for exhausting unwanted air from a room.

A more specific object of the invention is to provide apparatus to selectively open and close a port in a self contained air conditioning unit for accomplishing exhaust of air from an enclosure served by an air conditioning unit.

Another object of the invention is to provide apparatus as above which is economical to manufacture and maintain, simple in construction, easy to operate and compact in size and number of parts.

Other objects will be apparent from the description to follow and from the appended claims.

The preceding objects are achieved according to the preferred embodiment of the invention by the provision of a pivotally mounted door covering the port and biased by means of a spring to the closed position. A slidably movable carriage located adjacent to a tab extending from the door and actuated by means of a pushbutton engages the tab displacing the tab against the action of the spring and opening the door. A pin mounted on a resilient arm fixed to the carriage and in contact with a ramp having a multiplicity of surfaces, all angled from the direction of motion of the carriage, follows said surfaces upon displacement of the carriage. Upon the application and release of a first force to the pushbutton, the carriage is displaced and the pin follows certain ramp surfaces and is maintained at least in part by said surfaces at a fixed position to hold the door open. Upon a second application and release of force to the pushbutton, the pin follows other ramp surfaces and returns to its original position allowing the door to close.

DESCRIPTION OF THE PREFERRED EMBODIMENT

The embodiment of the invention described below is adapted for use in a self contained air conditioning unit of the so-called room air conditioner type having a partition separating the evaporator section from the condenser section of the unit although it is to be understood that the invention finds like applicability in other forms of air conditioning units. Furthermore, the preferred embodiment described below is for a single port; however, it is to be understood that multiple ports are often used in air conditioners and that the embodiment can be duplicated to provide door mechanisms for a multiplicity of doors. Specifically, some air conditioning units have vent ports as well as exhaust ports and two mechanisms as hereafter described could be utilized, one for each port.

Figure 1:
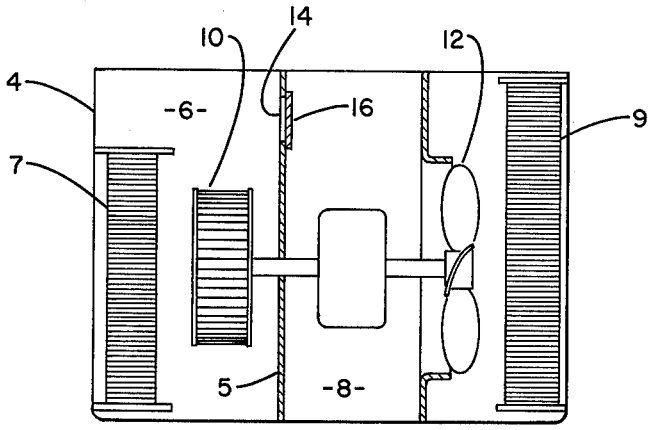
FIG. 1 is a schematic view of a self contained room air conditioning unit.
Figure 2:
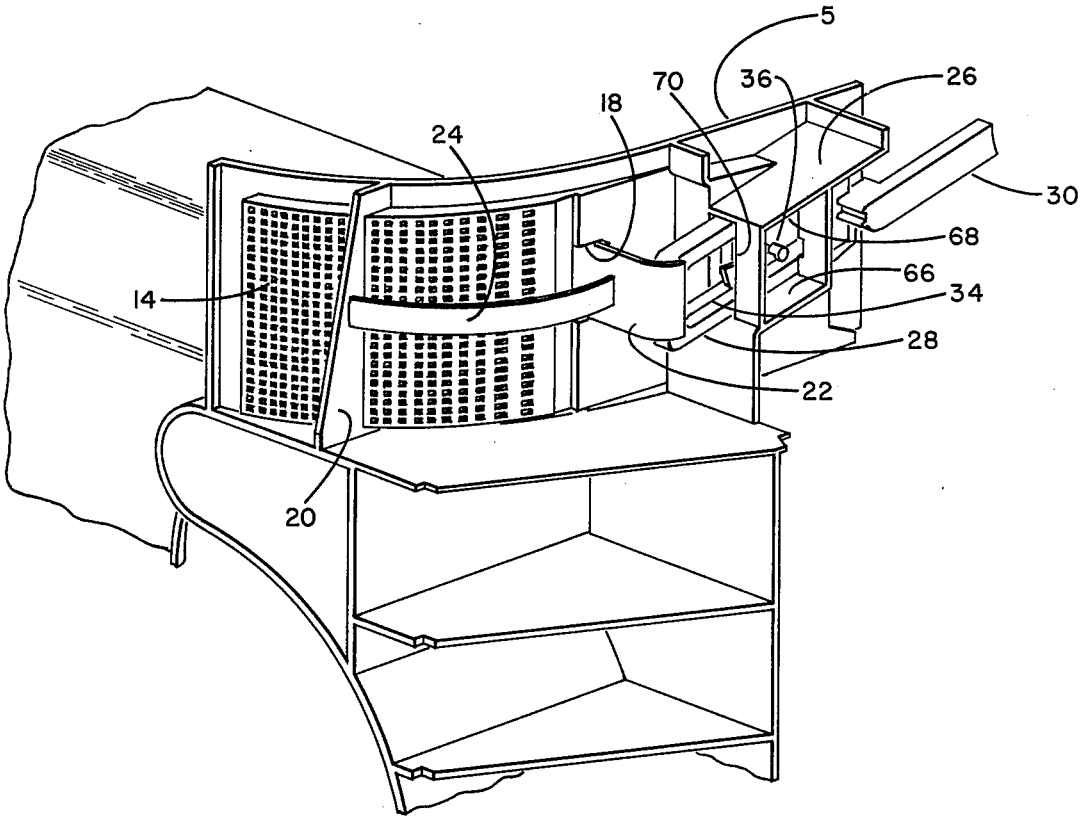
FIG. 2 is a perspective view of the apparatus for moving a door covering a port in a partition according to the invention.
Figure 3:
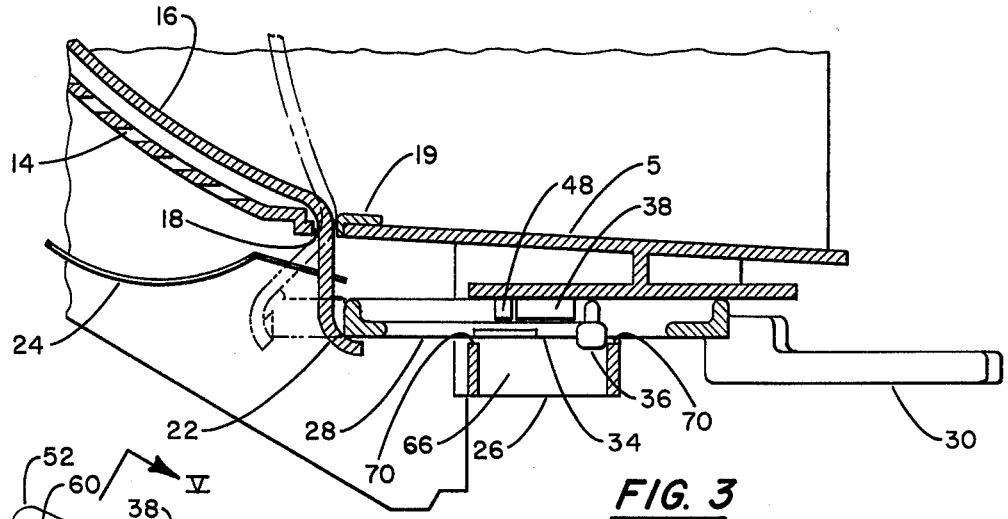
FIG. 3 is a partial top view of FIG. 2.

Referring now to the drawings, FIG. 1 shows in schematic form an air conditioning unit. The unit includes a casing 4 having a base pan (not shown) on which the various parts are mounted. A partition 5 divides the unit into an evaporator section 6 containing an evaporator 7 and an evaporator fan 10, and a condenser section 8 containing a condenser 9 and a condenser fan 12. The unit is adapted for installations in a room with the evaporator section communicating with air in the room and the condenser section communicating with the outside air. The condenser and evaporator are part of a conventional refrigeration circuit with a compressor (not shown) and an expansion device (not shown). The evaporator serves to absorb heat from the room air and the condenser serves to discharge heat to the outside air. An exhaust port 14 is defined in partition 5 for the communication of the condenser section of the unit with the evaporator section of the unit, said port being covered by door 16. Evaporator fan 10 creates sufficient air pressure differentials to exhaust air from the room, said air being induced from the room into the evaporator section of the unit and then forced thru port 14 (assuming door 16 is open) into the condenser section of the unit. The combination of the action of the evaporator fan and the action of the condenser fan force the air thru port 14 and then blow the air outside from the condenser section.

FIGS. 2–6 illustrate apparatus for controlling the opening and closing of port 14. The apparatus depicted enables the door to be moved to pre-selected positions. Port 14 in partition 5 is covered by a door 16. Tab 22 is attached to door 16 to form an integral item, the tab being substantially perpendicular to the door and projecting thru slot 18 in partition 5. Door 16 and tab 22 are tightly mounted for pivotal movement in slot 18. A bracket 20 being an integral part of partition 5 is located on the partition at the opposite side of port 14 from tab 22. A compression spring 24 is fixed on one end to bracket 20 and on the other end to tab 22 so that tab 22 is biased away from bracket 20 holding door 16 in a closed position covering port 14.

On the opposite side of tab 22 from port 14 are mounted a set of guides 26, said guides consisting of four thin walls perpendicular to the partition arranged in a parallelogram. A carriage 28 consisting of a rectangular frame is mounted so that it is slidably movable back and forth within the guides. The upper side of bottom wall 66 of the guide parallelogram and the bottom side of the top wall 68 of the parallelogram are sliding surfaces on which the outer edges of carriage 28 travel. The two vertical walls have guide openings 70 therein commencing at the partition and wide enough to allow a loose fit of carriage 28, said openings running the full height of the parallelogram.

The carriage 28 directly contacts tab 22 on one end and on the other end has attached thereto an actuating means, shown as pushbutton 30. A force applied to pushbutton 30 displaces the carriage through guides 26 to engage tab 22. As tab 22 is displaced against the action of spring 24 door 16 is opened and simultaneously spring 24 exerts a return force tending to close door 16 and return carriage 28 to its original position.

Integrally attached to end of carriage 28 adjacent to tab 22 and being within a plane parallel to the plane of partition 5 interior to the frame of the carriage is resilient arm 34. (See FIGS. 2 and 3) Resilient arm 34 is flexible in all directions but has an at rest position where it is neither stressed nor displaced in the plane of the carriage.

Mounted on partition 5 and being an integral part thereof is ramp 32 comprising an embossment having a multiplicity of sliding surfaces defined by discontinuities on the surface of the embossment. Mounted on the end of resilient arm 34 is a pin 36 with the axis of the pin being perpendicular to partition 5 and the edges of the pin being in contact with the sliding surfaces of ramp 32. Ramp 32 is located in a position on partition 5 so that upon displacement of carriage 28 with the attached resilient arm 34 and pin 36, the pin will be able to contact the sliding surfaces of the ramp.

Figure 6:
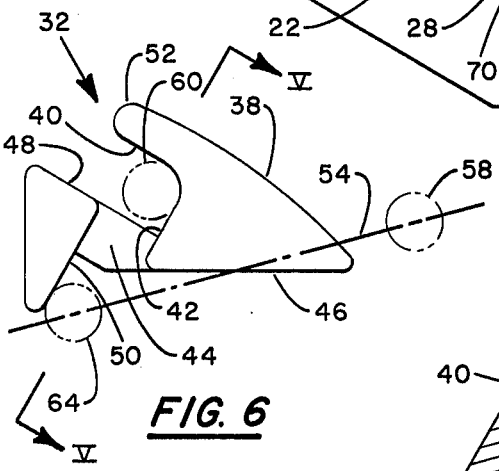
FIG. 6 is an enlarged elevational view of the ramp in FIG. 4.
Figure 5:
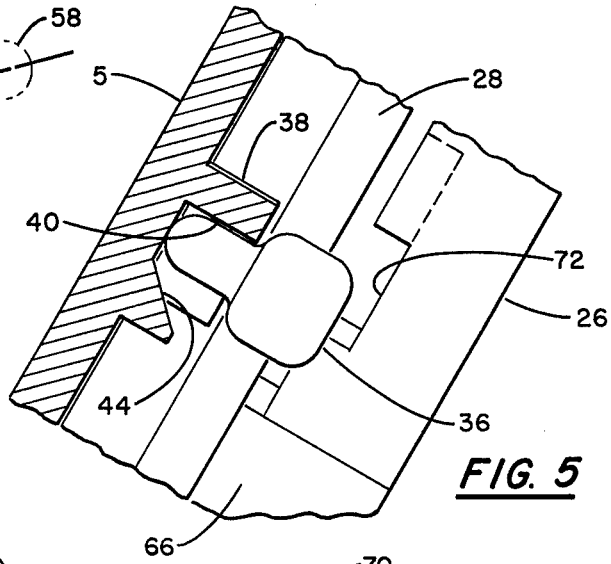
FIG. 5 is a cross section of FIGS. 4 and 6 taken at V—V.
Figure 4:
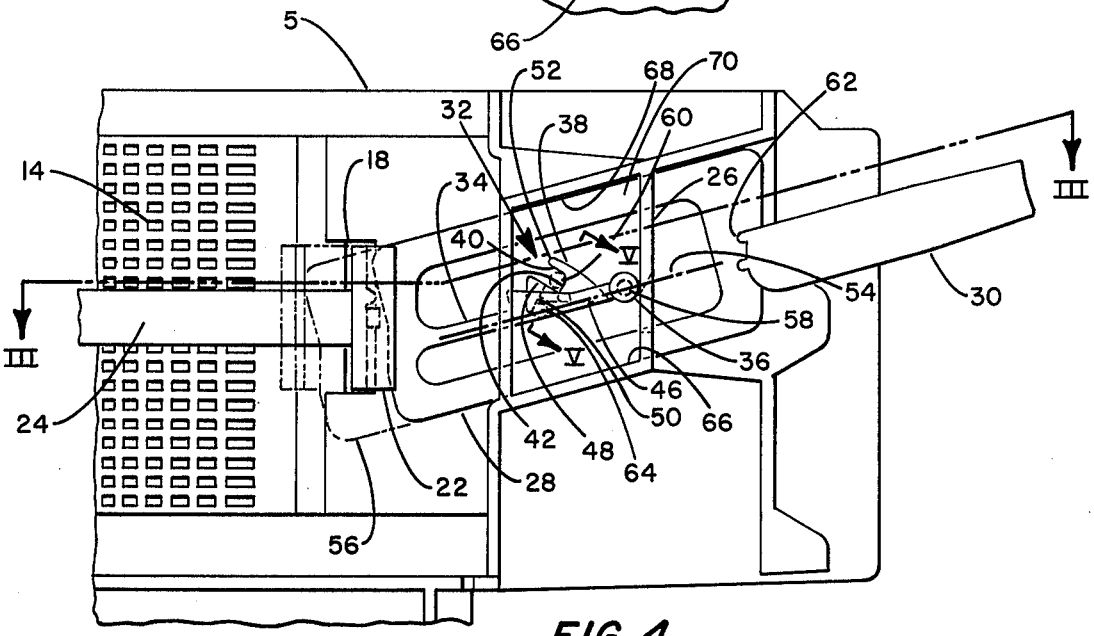
FIG. 4 is an elevational view of FIG. 2.

Referring now to FIG. 6 which is an enlarged elevational view of ramp 32, it can be seen indicated thereon the direction of motion 56 of carriage 28. Also indicated thereon and parallel to the direction of motion 56 is a line indicating the at rest position of resilient arm 54 in the various possible locations as carriage 28 is displaced.

Location 58 indicates the position of pin 36 in relation to ramp 32 in the beginning position of the door open-close cycle. As carriage 28 is displaced from right to left on FIG. 6 by the application of a force thru the pushbutton, the pin travels from location 58 along the path of the resilient arm at rest position 54 until it reaches cam surface 38 on the ramp. As the carriage continues to move to the left the pin follows cam surface 38 until it reaches connecting surface 52, with the resilient arm continually being displaced (and stressed) from the at-rest position as the pin travels along cam surface 38. Connecting surface 52 is semicircular and joins cam surface 38 with first retention surface 40. As the carriage continues to move to the left the pin passes over connecting surface 52 and then as a result of the bias toward the resilient arm rest position created by the displacement of the resilient arm, the pin is moved closer to said rest position. A first retention surface 40, a second retention surface 42, an inclined cam surface 44, and a first stop surface 48 form a notch for holding the pin after it leaves connecting surface 52.

Movement of carriage 28 to the left is stopped by limit surface 62 of pushbutton 30 contacting guides 26. When the carriage is fully displaced to the left, pin 36 will contact the first stop surface 48 after leaving connecting surface 52. Upon a release of the force to the left, then the action of spring 24 will return carriage 28 and the pin to the right until the pin comes to rest at location 60 contacting either first retention surface 40, second retention surface 42, or the inclined cam surface 44. When the pin is held in this position by the return force exerted by the spring, carriage 28 is displaced and the door is held in the open position.

As carriage 28 is again displaced from right to left by the second application of a linear force, the bias of the resilient arm 34 moves pin 36 onto and partially over inclined cam surface 44. Inclined cam surface 44 forms an acute angle with the partition and the base of the inclined cam surface is in the plane of partition 5, said surface being inclined upward from the plane of the partition towards the resilient arm at rest position. (All other ramp sliding surfaces are perpendicular to partition 5).

As the pin is further displaced to the left along inclined cam surface 44, it contacts a second stop surface 50 which is angled against the direction of motion to force the pin up inclined cam surface 44. As the pin is further displaced to the left, it slides along the second stop surface and the inclined cam surface until it passes completely over the inclined cam surface 44. At that point the resilient arm bias returns the pin to location 64 on the line of resilient arm rest position 54. The pin also returns as a result of the bias in the resilient arm created by traveling up and over inclined cam surface 44 to its original distance from partition 5. Movement to the left of the carriage 28 is thereafter stopped by the limit surface 62 of pushbutton 30 contacting guides 26.

Upon the release of the force applied to the pushbutton 30, the action of the spring 24 then displaces the carriage and pin from left to right on FIG. 6. Pin 36 travels from location 64 along the line of resilient arm rest position 54 until it contacts return surface 46. As the carriage continues to move to the right the pin follows return surface 46 being continually displaced until it reaches the intersection of cam surface 38 with return surface 46. As the carriage moves further to the right, the pin passes said intersection and as a result of the bias created by displacement, snaps back to resilient arm rest position 54 at location 58, the start position for the entire cycle and the position where door 16 is closed.

The carriage is limited from movement to the right by pin 36 contacting guides 26 and further by door 16 limiting the spring force once it is in the closed position. It is apparent that additional stop surfaces could be incorporated into the ramp to limit the motion of the carriage. It is further apparent that additional ramp surfaces could be incorporated into the mechanism to provide for additional notches to maintain the door in intermediate positions.

For ease in construction, the above described door control mechanism is manufactured in four basic parts. The partition 5, bracket 20, guides 26 and ramp 32 with all of its surfaces are a single integral plastic molding. Carriage 28, pushbutton 30, resilient arm 34 and pin 36 are an additional single, integral plastic molding. The third part is door 16 and tab 22, another single, integral plastic molding. The fourth part is spring 24.

The door and tab molding is mounted by insertion of the tab thru slot 18 in the partition. The compression spring is mounted to the assembly by the insertion of the tabs on each of its spring ends into an appropriate hole in bracket 20 for one end and tab 22 for the other end. The carriage piece is simply inserted thru guide openings 70 in guides 26 with resilient arm 34 being displaced to allow the head of pin 36 to pass thru insertion slot 72 in guide 26 and once thru the resilient arm being released. Disassembly of the invention is merely the reverse of the above described procedure.

The described control mechanism could be used to control other components of an air conditioning unit such as a switch or other physically operated unit. Furthermore, a filler, such as filler 19 shown on FIG. 3, may be inserted in slot 18 to tightly hold the door and tab for pivotal movement. Slot 18 is designed to be sufficiently close fitting to make a filler piece unnecessary; however, the use of a filler can correct any irregularities in the slot to provide for appropriate door movement.

It is therefore obvious that the invention as above described in the preferred embodiment provides an economical, easy to assemble and relatively maintenance free means of controlling an internal door of an air conditioning unit.

The invention has been described in detail with particular reference to a preferred embodiment thereof, but it will be understood that variations and modifications can be effected within the spirit and scope of the invention.

We claim:

1. In an air conditioning unit having a casing, a partition dividing the unit into an evaporator section and a condenser section, an evaporator fan in the evaporator section of the unit and a condenser fan in the condenser section of the unit, means defining a port in the partition;

a door for opening and closing the port;

means for mounting the door for movement between port opening and closing positions, said mounting means including spring means biased to hold the door in a predetermined position; and means for moving the door, said door moving means including a ramp with a multiplicity of surfaces, displaceable carriage means movable in relation to the ramp, a pin associated with the carriage means and in contact with the ramp, and activating means extending from the carriage means whereby upon the application of force to the carriage means, the carriage means is displaced against the action of the spring with the pin following a path defined by certain of the ramp surfaces so that the door is moved to a first preselected position and maintained therein and upon a subsequent application and release of the force the pin follows a path defined by other of the ramp surfaces with consequent moving of the door to a second preselected position and maintained therein.

2. Apparatus according to claim 1 wherein the mounting means for the door is located adjacent the carriage, said door is mounted for pivotal movement relative to the partition, and has attached thereto a tab in the plane of the axis of the pivotal movement of the door, said door further including a port closing portion in the plane of axis of the pivotal movement of the door for covering the port.

3. Apparatus according to claim 2 wherein the door mounting means includes a bracket mounted on the partition, said spring means engaging the bracket and tab to bias the door to a predetermined position.

4. Apparatus according to claim 1 and further comprising;

guide means attached to the partition, said guide means supporting said carriage for movement therein.

5. Apparatus according to claim 4 wherein said guide means and said ramp means are integrally formed with said partition.

6. Apparatus according to claim 4 wherein the actuating means is a manually operated pushbutton.

7. Apparatus according to claim 6 wherein the pushbutton, the carriage, the resilient arm and the pin are a unitary item; and wherein the ramp with all of its surfaces, the guides, the bracket, the port and the partition are a unitary item.

8. Apparatus according to claim 6 wherein the carriage is limited in motion in one direction by engagement of the pushbutton with the guides and in the other direction by engagement of the pin with the guides.

9. Apparatus according to claim 1 including a resilient arm having one end fixed to said carriage means and serving to mount said pin.

10. Apparatus according to claim 9 wherein said door mounting means includes a door located adjacent to the carriage mounted for pivotal movement, and a tab extending from the door in the plane of the axis of pivotal movement, a bracket attached to the partition, and said spring means being interposed between the bracket and the tab to bias the door to the closed position.

11. Apparatus according to claim 10 wherein the carriage engages the tab to apply torque for opening the door; and wherein the ramp has a multiplicity of surfaces for engaging the pin, several of which are juxtaposed to form a substantially V-shaped notch whereby the pin is held within the notch by the spring upon release of the force applied to the carriage for the purpose of changing the position of the door.

12. Apparatus according to claim 11 wherein the ramp surfaces are all angled from the direction of motion of the carriage.

13. Apparatus according to claim 12 and further including as part of the ramp first and second retention surfaces and an inclined cam surface, whereby upon the first slidable motion the pin becomes held by said surfaces maintaining the door in an open position;

and a return surface, whereby upon the second slidable motion in the same direction the pin is released and allowed to return to the start position allowing the door to close.

14. Apparatus according to claim 13 wherein the ramp has a cam surface forming an acute angle with the direction of motion of the carriage, and said surface crossing the resilient arm at rest position, a first retention surface substantially parallel to the cam surface and located closer to the resilient arm at rest position than the cam surface;

a connecting surface substantially semi-circular and joining the cam surface with the first retention surface;

a second retention surface perpendicular to the first retention surface and connected at their common end;

an inclined cam surface wherein the base which lies within the plane of the partition is perpendicular to and connected with the second retention surface forming a substantially V-shaped notch with the first and second retention surfaces, the face of the inclined cam being inclined toward the resilient arm at rest position forming an acute angle to the partition;

a return surface forming an acute angle with the direction of motion and being connected at the top of one end of the inclined cam surface and extending therefrom across the resilient arm at rest position to and being connected at the other end with the end of the cam surface;

a first stop surface parallel to the base of the inclined cam surface and connected thereto and located further from the resilient arm at rest position than the base of the inclined cam;

a second stop surface perpendicular to the base of the inclined cam surface and connecting the intersection of the base of the inclined cam surface and the first stop surface with the intersection of the inclined cam surface and the return surface;

all surfaces except for the inclined cam surface being perpendicular to the partition and running from the intersection of the ramp with the partition the full height of the ramp, whereby a continual sliding surface is provided for the displacement of the pin and resilient arm relative to the resilient arm at rest position.

* * * * *